US008042477B2

(12) United States Patent
Lee

(10) Patent No.: US 8,042,477 B2
(45) Date of Patent: Oct. 25, 2011

(54) SHELVING SYSTEM WITH STABILIZING BRACKETS AND METHOD OF ASSEMBLY

(75) Inventor: James Lee, Old Tappan, NJ (US)

(73) Assignee: Organize-it-All Inc., Teterboro, NJ (US)

( * ) Notice: Subject to any disclaimer, the term of this patent is extended or adjusted under 35 U.S.C. 154(b) by 846 days.

(21) Appl. No.: 12/150,853

(22) Filed: May 1, 2008

(65) Prior Publication Data

US 2009/0184076 A1 Jul. 23, 2009

Related U.S. Application Data

(63) Continuation-in-part of application No. 12/017,920, filed on Jan. 22, 2008.

(51) Int. Cl.
*A47B 47/00* (2006.01)

(52) U.S. Cl. ..... 108/147.12; 108/147.17; 108/109

(58) Field of Classification Search ..... 108/147.17, 108/147.15, 157.13, 157.1, 158.13, 159, 108/109, 110, 186, 193, 147.11, 147.12, 108/147.13, 147.14

See application file for complete search history.

(56) References Cited

U.S. PATENT DOCUMENTS

| | | | | | |
|---|---|---|---|---|---|
| 1,820,716 | A * | 8/1931 | Vance | 108/109 |
| 1,952,111 | A * | 3/1934 | Bales | 108/107 |
| 2,013,118 | A * | 9/1935 | Vershbow et al. | 108/157.13 |
| 3,215,387 | A * | 11/1965 | Thompson et al. | 248/224.7 |
| 3,696,763 | A * | 10/1972 | Evans | 108/157.13 |
| 4,154,419 | A * | 5/1979 | Breidenbach | 248/243 |
| 4,257,333 | A * | 3/1981 | Pollack | 108/147.13 |
| 4,537,379 | A | 8/1985 | Rhoades | |
| 4,582,001 | A * | 4/1986 | Leikarts | 108/106 |
| 4,637,323 | A * | 1/1987 | Nicely | 108/107 |
| 4,852,501 | A * | 8/1989 | Olson et al. | 108/107 |
| 5,035,186 | A * | 7/1991 | Uredat et al. | 108/159 |
| 5,174,200 | A * | 12/1992 | Jeandel et al. | 108/187 |
| 5,531,167 | A * | 7/1996 | Stevens et al. | 108/106 |
| 5,579,703 | A * | 12/1996 | King | 108/186 |
| 5,622,415 | A | 4/1997 | Felsenthal et al. | |
| 5,695,081 | A * | 12/1997 | Alkalay | 211/187 |
| 5,915,659 | A * | 6/1999 | Scannell, Jr. | 248/371 |
| 6,082,070 | A * | 7/2000 | Jen | 52/650.3 |
| 6,253,933 | B1 * | 7/2001 | Yang | 211/187 |
| 6,302,284 | B1 * | 10/2001 | Zonshin | 211/187 |
| 6,311,856 | B2 * | 11/2001 | Battaglia et al. | 211/187 |
| 6,341,566 | B1 * | 1/2002 | Hwang | 108/180 |
| 6,431,090 | B1 * | 8/2002 | Davis et al. | 108/107 |
| 6,443,410 | B1 | 9/2002 | Lee | |
| 7,086,633 | B2 * | 8/2006 | Welch et al. | 248/218.4 |
| 7,100,781 | B2 | 9/2006 | Craft | |
| 7,128,221 | B2 | 10/2006 | Metcalf | |
| 7,314,143 | B1 | 1/2008 | Johnson | |
| 7,581,709 | B2 * | 9/2009 | Gillespie et al. | 249/19 |
| 2006/0202091 | A1 * | 9/2006 | Oddsen et al. | 248/122.1 |

* cited by examiner

*Primary Examiner* — Michael Safavi

(74) *Attorney, Agent, or Firm* — Frommer, Lawrence & Haug LLP; Ronald R. Santucci

(57) ABSTRACT

A shelving system includes one or more shelving units. Each shelving unit has posts each post having one or more indents, connectors with slots for mounting the post and one or more shelves. Each shelf has protrusions on a periphery to insert into one of the connector slots. Each shelving unit and shelving system can be assembled, disassembled, and adjusted without the use of tools or other components. The shelving units can be assembled together to create a multiple shelving unit system without the use of tools or other components.

20 Claims, 8 Drawing Sheets

SHELVING SYSTEM WITH STABILIZING BRACKETS AND METHOD OF ASSEMBLY

This application is a continuation-in-part of U.S. patent application Ser. No. 12/017,920 filed on Jan. 22, 2008, which is incorporated herein by reference in its entirety.

BACKGROUND OF THE INVENTION

1. Field of the Invention

The invention relates generally to a shelving system. More particularly, this invention pertains to a shelving unit wherein the number and location of the shelves can be adjusted, and a shelving system wherein two or more shelving units can be connected in width and/or depth. The shelving unit and the system can be speedily and easily assembled, disassembled, or adjusted, without tools.

2. Description of Related Art

When assembling shelving systems, shelving pieces are usually connected to a frame or frame pieces with screws. However, to make the connection sturdy, components other than screws, such as screw caps, brackets, or glue, are often necessary. Thus, using screws or the like to assemble the frame and shelving requires the user to perform complicated assembly operations, using an assortment of components. Furthermore, the use of screws or the like implies the need for tools, such as a screwdriver. Consequently, assembly, disassembly, or even adjustment of such a shelving system is slow and inconvenient. Moreover, repeated disassembly and reassembly wear out screw joints, resulting in a loose shelf connection.

SUMMARY OF THE DISCLOSURE

In one aspect of the invention, a shelving unit includes a post having one or more indents along a length and a shelf having one or more protrusions on a periphery. A connector has a first slot to receive the post and has a latch on the exterior. The latch in a first position engages an indent on the post and in a second position disengages the indent. The connector has a second slot to receive a shelf protrusion. The connector is mounted to the post by inserting the post in the first slot, sliding the connector to a desired location on the post, and putting the latch in the first position that inhibits further sliding of the connector.

In a particular embodiment of the connector, the post mounting slot has an aperture on a periphery that is not joined with another slot. A first latch end shaped to engage the indent is rotatably mounted on the exterior adjacent to the aperture. In an closed position, the first latch end inserts through the aperture and engages the indent on the post, and a second latch end is pushed to lock the first latch end in the indent securing the connector onto the post.

In another aspect of the invention, a second connector is mounted on a second post at the location corresponding to the first shelf, and a second protrusion of the first shelf is inserted into a second slot of the second connector. These steps can be repeated for any additionally desired shelf-to-post connection.

In another aspect of the invention, an apparatus and a method for mounting an additional shelf on the shelving unit includes mounting a connector at the next desired location on the post, closing the latch, and inserting the shelf's protrusion into a slot.

In a third aspect of the invention, an apparatus and a method for a shelving system includes to or more shelving units. A shelving unit includes a connector having a third slot.

The post mounting slot receives the post and secured thereon with the latch in a closed position. A second slot receives a shelf protrusion of a first shelf. The third slot receives a protrusion of a second shelf, mounting the first and second shelves jointly using one connector mounted on one post.

DETAILED DESCRIPTION

In general, the shelving system of the present disclosure includes one or more shelving units. Each shelving unit has one or more shelves. Each shelf has a protrusion on a periphery of the shelf which can be vertical or horizontal. The protrusion is inserted into a slot of the slidably mounted connector on the post. The latch can be rotatable about a hinge into a first position and a second position. In the first position, the latch inhibits the connector from sliding along the post. In the second position, the latch enables the connector to slide along the post to a desired height for the shelf.

Figure 1:
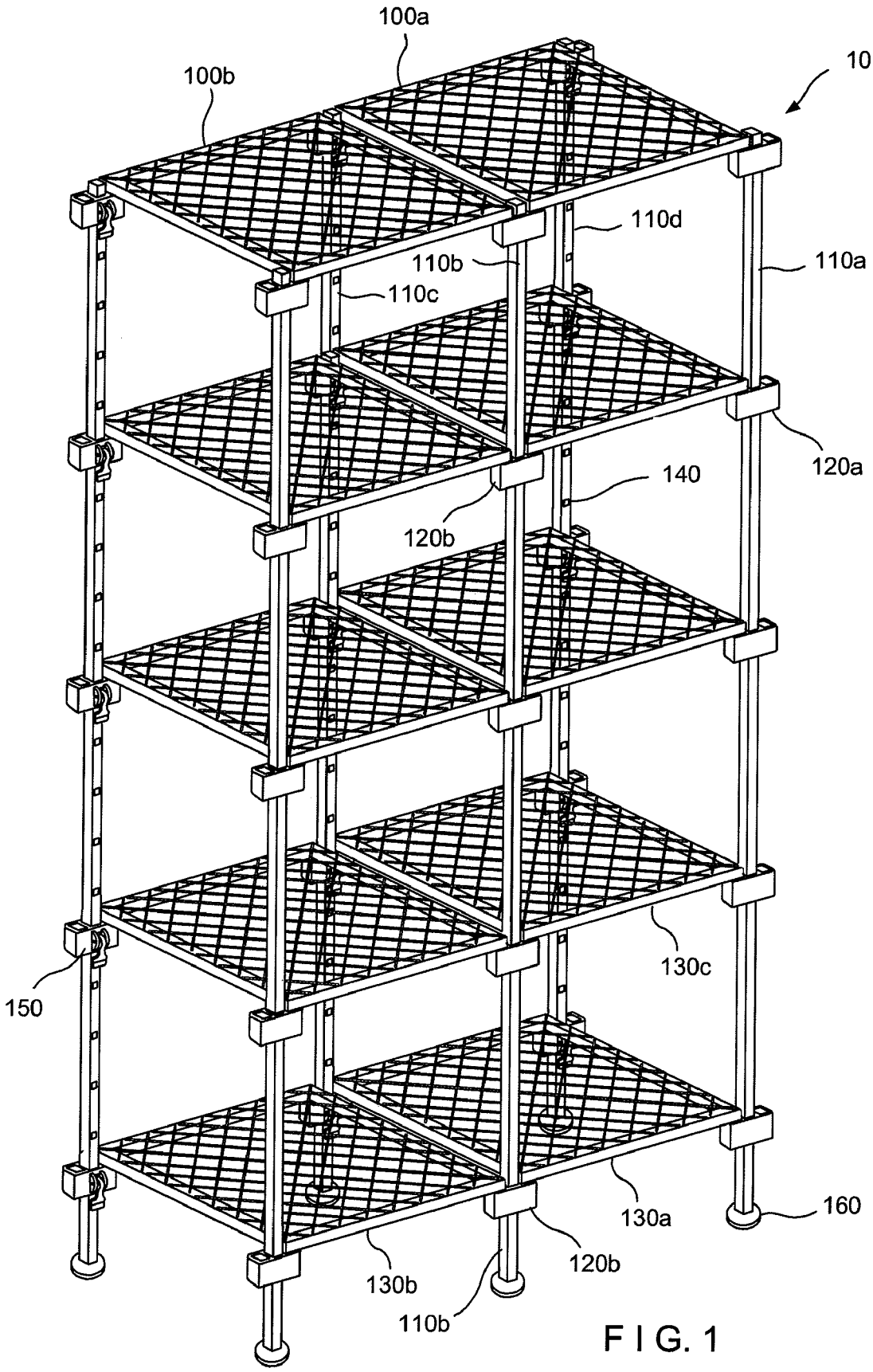
FIG. 1 illustrates a perspective view of an embodiment of a shelving system according to the present disclosure.

FIG. 1 illustrates a first embodiment of a shelving system 10 including two shelving units 100*a* and 100*b*. Shelving unit 100*a* has posts 110*a*, 110*b*, 110*c*, and 110*d*, each having one or more indents 140 along a length of each post. Connector 120*a* is mounted on post 110*a* by inserting post 110*a* into a post mounting slot on connector 120*a*. Connector 120*a* is slidable over the length of post 110*a* to an indent 140 at a desired shelf location, where the connector is secured using latch 150 formed on the exterior of connector 120. Shelf 130*a* is mounted on connector 120*a* by inserting a protrusion (not shown), described herein below, on shelf 130*a* into a second slot on connector 120*a*. This process may be repeated for any additional protrusion-to-post connections according to the design of the shelving unit, using the necessary number of additional connectors 120*a*.

To add another shelving unit 100*b* to form a shelving system 10, a connector 120*b* is used to connect shelf 130*a* to post 110*b*. Connector 120*b* has a third slot. After mounting the post 110*b* on the post mounting slot of connector 120*b* and mounting the first shelf 130*a* on post 110*b*, a second shelf 130*b* is mounted on connector 120*b* by inserting a protrusion of shelf 130*b* into the third slot.

To add an additional shelf 130*c* to shelving unit 100*a*, another connector 120*a* is slid over post 110*a*, latched at the desired height, and then shelf 130*c* is mounted similar to that described herein above. This process may be repeated for each additional post-shelf connection for shelf 130*c*.

In one embodiment, shelf 130 is a polygonal shape although the shape of the shelf can be curved or a combination of curved and straight edges. In a particular embodiment, the shelf is rectangular and the connectors 120*a* and 120*b* are mounted on the shelf substantially at the corners of the shelf. Connectors 120 have slots as described herein and engage posts 110 substantially at the corners of the shelf 130. Each post 110 can have a foot 160, which can make the shelving unit slidable, stable, harmless to the flooring material, or improve the appearance of the shelving unit.

Figure 7:
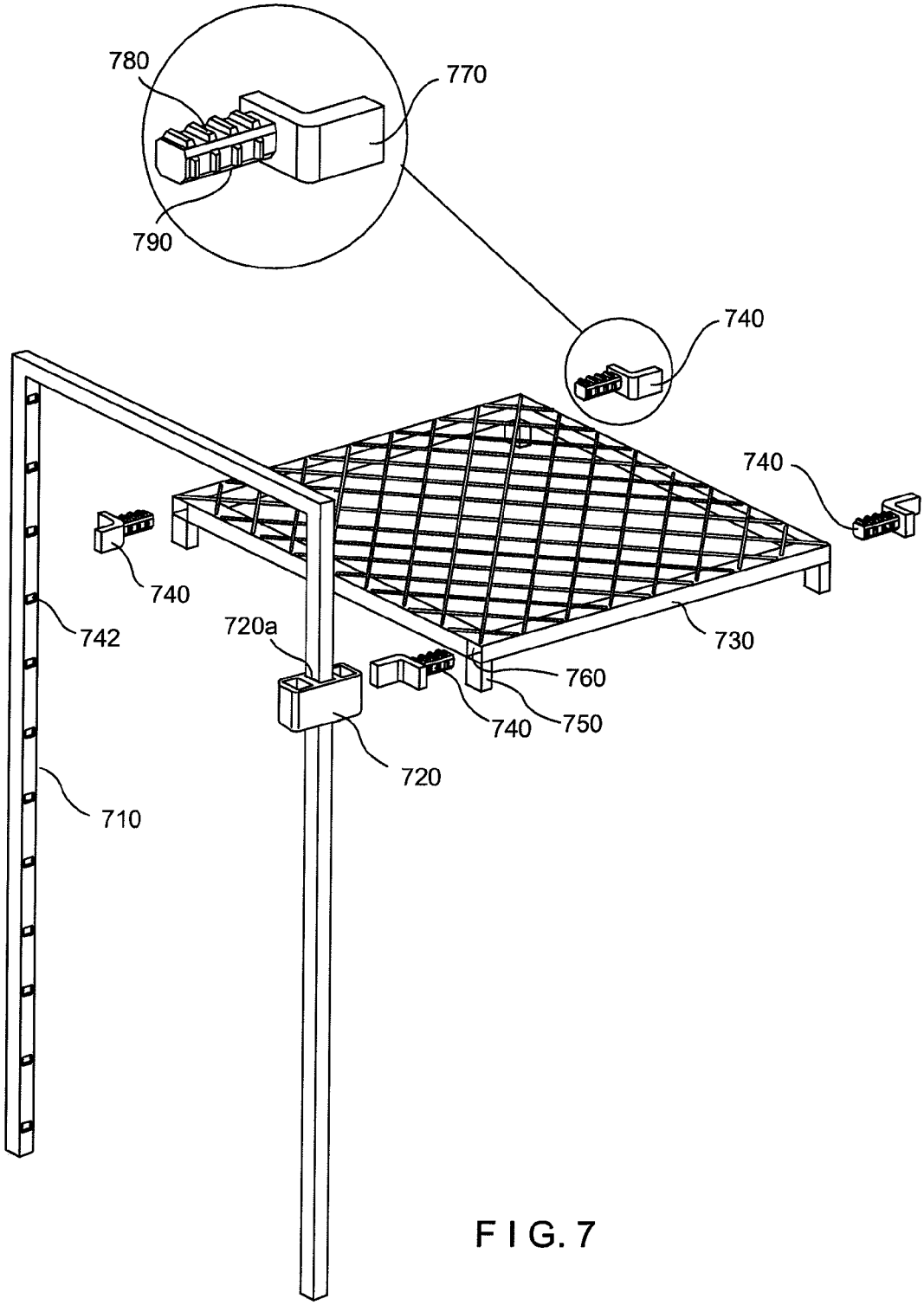
FIG. 7 illustrates a perspective view of a stabilizing bracket assembled to a shelving unit.

FIG. 7 illustrates an embodiment of the shelving unit having optional support brackets 740. Support bracket 740 can be made of any suitable material including plastic or metal. Support bracket 740 has a mounting portion 790 and a stabilizing portion 770. Mounting portion 790 may have ridges 780 that extend outwardly and are deformable. Stabilizing portion 770 is in a shape to engage a post 710. In a particular embodiment, post 710 is rectangular and stabilizing portion 770 is L-shaped. In this embodiment, shelf 730 has a tubular frame that has openings 760. Shelf 730 is a rectangular shelf made of a rectangular tube having rectangular openings 760 at the corners thereof. Shelf 730 has protrusions 750 at the corners thereof adjacent openings 760. Mounting portion 790 is insertable into opening 760. In an implementation, mounting portion 790 is press-fit into openings 760 and ridges 780 deform to enable retention of mounting portion 790 in opening 760. Stabilizing bracket 740 may be retained in the opening 760 by frictional forces between ridges 780 and tubular frame of the shelf 730. Similar to the discussion above with respect to FIG. 1, A connector 720 is slidable over the length of post 710 to an indent 742 at a desired shelf location, where the connector is secured using latch (not shown) formed on the exterior of connector 720.

In addition to the assembly of the shelving system described with respect to FIG. 1, stabilizing brackets 740 are inserted into openings 760 of the tubular frame of shelf 730. Protrusions 750 are inserted into a slot 720*a* in connector 720. Insertion of the protrusion 750 into slot 720*a* captivates stabilizing bracket 740 therebetween. Moreover, stabilizing portion 740 engages post 710 and helps to reduce movement of the shelf when the shelving system is assembled.

Figure 8:
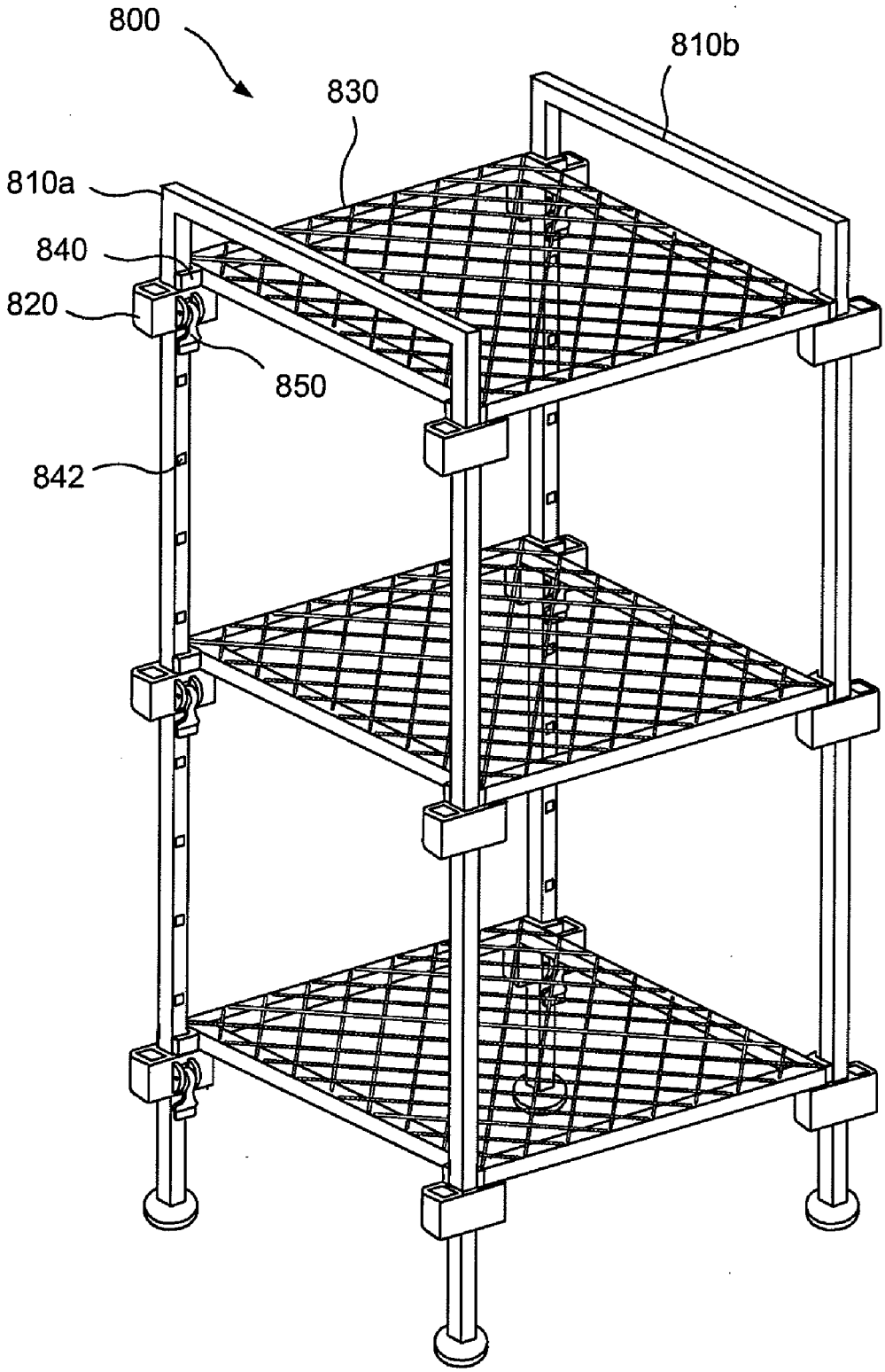
FIG. 8 illustrates a perspective view of a shelving system of the present disclosure having stabilizing brackets.

FIG. 8 illustrates a shelving system 800 according to the present invention that uses stabilizing brackets 840. In the embodiment illustrated, each shelf 830 is mounted between two posts 810*a*, 810*b* that are inserted into a first slot of a connector 820. Each connected is latched in place on the post by a latch 850 at an indent 842 as discussed herein above. A stabilizing bracket 840 is inserted into an opening (not seen) of a tubular frame of shelf 830. A protrusion (not seen) at each corner of shelf 830 is inserted into a second slot of respective connector 820 at each corner of the shelf captivating the respective stabilizing bracket therebetween. When so assembled, a stabilizing portion of the stabilizing bracket at each corner of the shelf engages a respective post to stabilize the shelf in position. Additional shelves 830 may be added to the shelving system in a similar manner.

Figure 2:
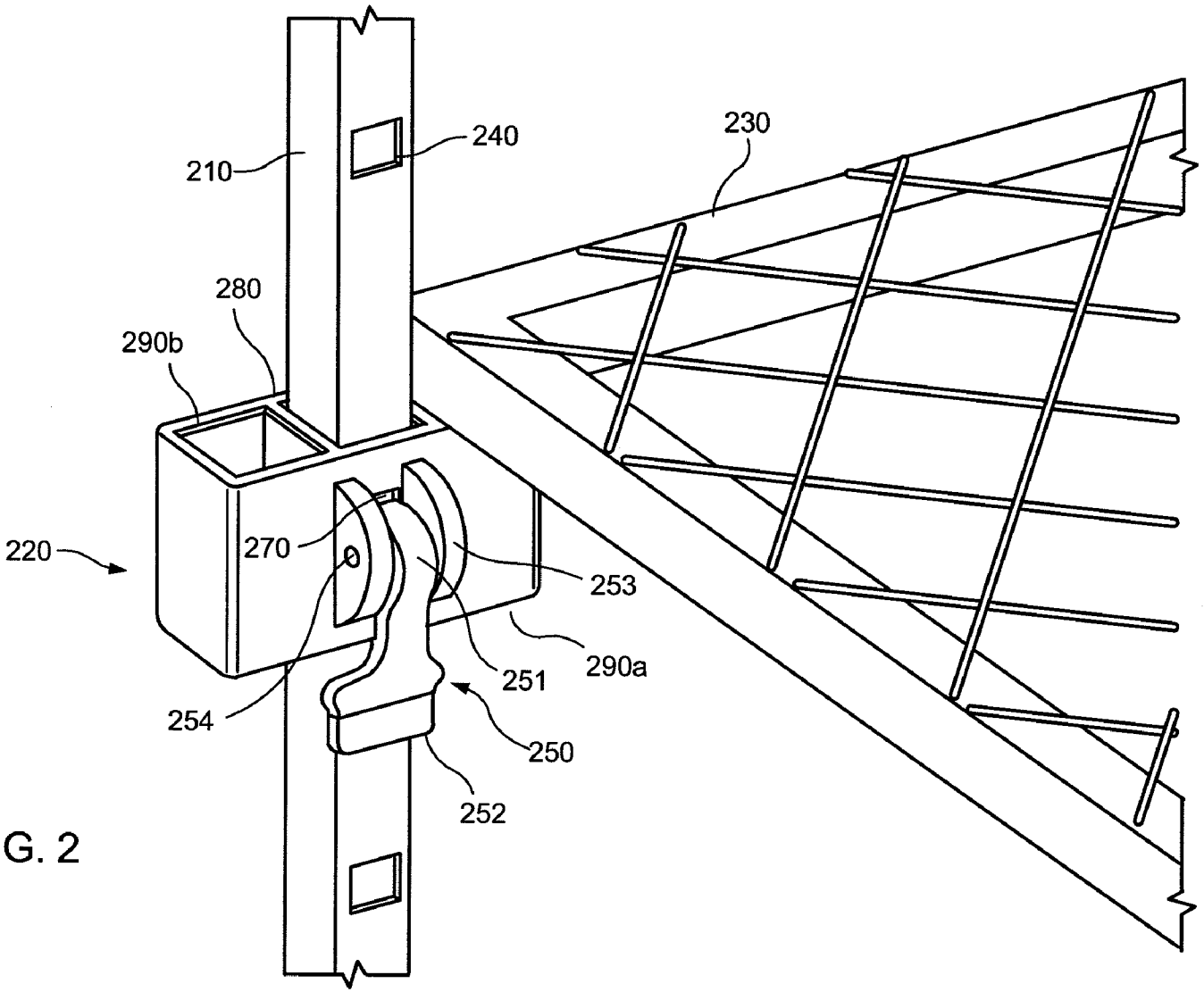
FIG. 2 illustrates assembly of a connector and a shelf on a post.

FIG. 2 illustrates an assembly of connector 220 and a corner of a shelf 230. Connector 220 is mounted to post 210 by inserting the post through post mounting slot 280. In one implementation, latch 250 is rotatable about a pin 254 mounted on connector 220 at a latch base 253 to a first position and a second position. Latch 250 has a first end 251 shaped to engage indent 240 on post 210 when the latch is in the first position and disengage the indent when the latch is in the second position. When latch 250 is rotated to the second, disengaged, position, connector 220 is enabled to slide along post 210 to a desired height. When latch 250 is rotated to the first, latched, position, latch end 251 passes through an aperture 270 in post mounting slot 280 to engage indent 240. In the latched position (shown) latch 250 locks connector 220 on post 210 at the height of an engaged indent 240. The connector 220 has a second slot 290*a* to receive a protrusion on the periphery of a shelf (see FIG. 3). The shelf protrusion inserts into slot 290*a*, mounting shelf 230 on post 210. Connector 220 can have an additional slot 290*b* that can receive the shelf protrusion of another shelf.

Figure 3:
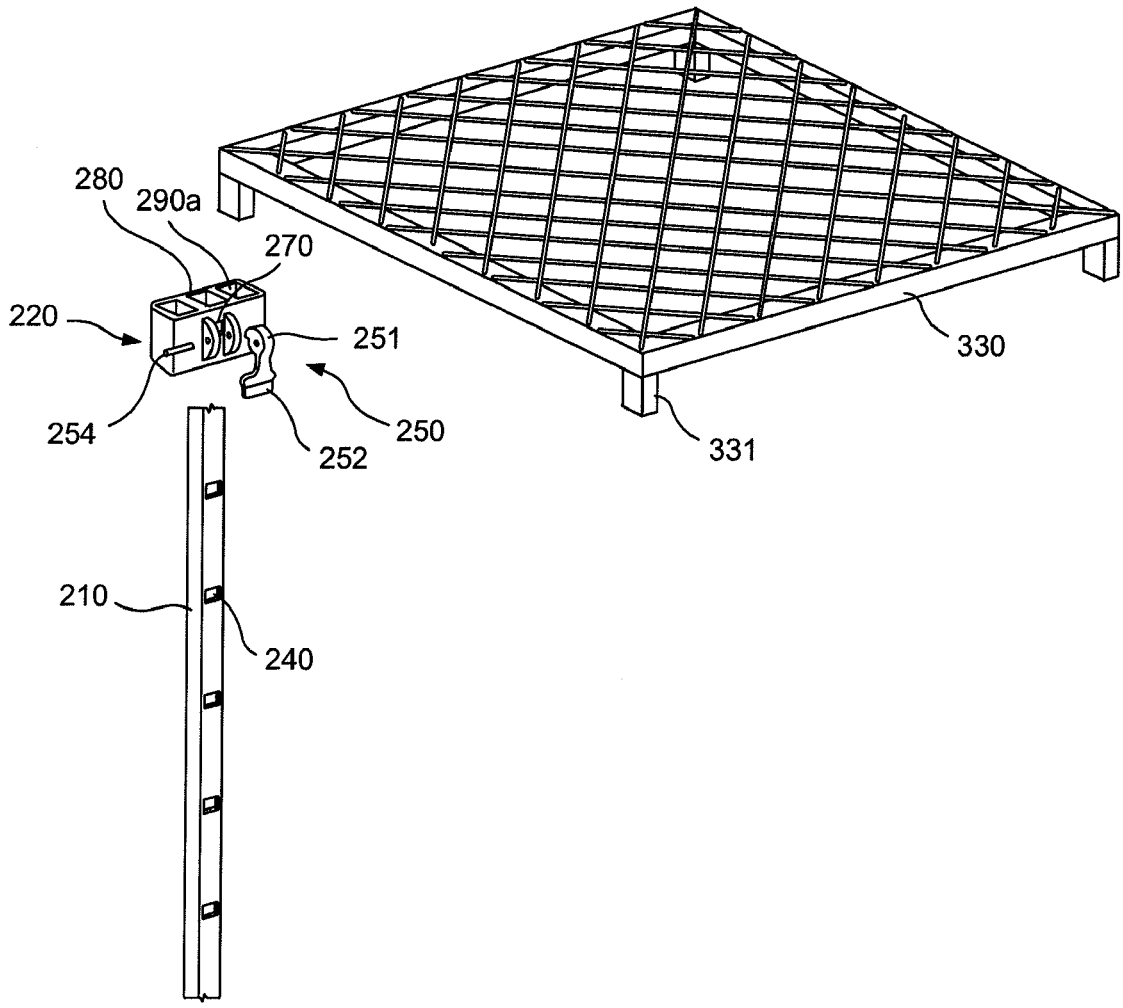
FIG. 3 illustrates a latch prior to mounting on a connector and a shelf and a post prior to assembly.

FIG. 3 illustrates details of the embodiment of FIG. 2 and shows connector 220, shelf 230, and post 210, disassembled. Pin 254 mounts latch 250 at latch end 251 on the exterior of post mounting slot 280 enabling latch 250 to pivot around pin 254. Connector 220 has post mounting slot 280 with aperture 270 through which latch end 251 engages indent 240 on post 210 and can be secured thereon by pushing latch end 252 to cause the latch to rotate around pin 254 to the first, latched, position. The pressure of the latch end 251 against the indent 240 can inhibit movement of the connector 220 along the post 210.

Shelf 330 has one or more vertical protrusions 331 which are shaped for insertion into shelf mounting slot 290*a* on connector 220. Thus inserted, protrusion 331 allows connection of shelf 330 to post 210 at the location of a connector 220 that can be placed at a desired indent 240.

Figure 4:
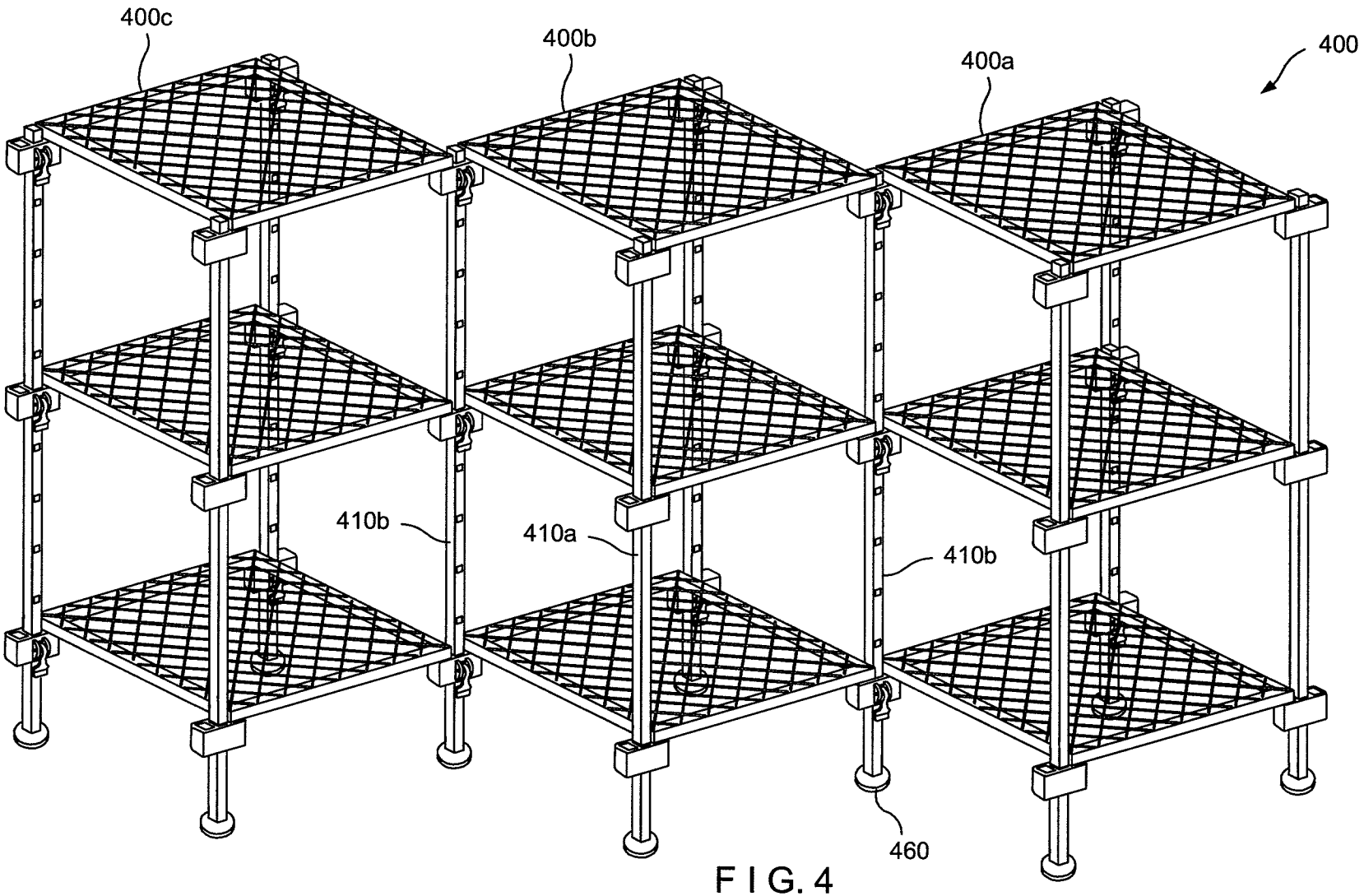
FIG. 4 illustrates a perspective view of an embodiment of a shelving system.

FIG. 4 illustrates a perspective view of a second embodiment of a shelving system 400 including three shelving units 400*a*, 400*b*, and 400*c*, joined in width. Each shelving unit 400*a*, 400*b*, 400*c* is joined to each another shelving unit using a common post 410*b*. Each post 410*a* and 410*b* can have a foot 460 to protect a floor and to help anchor the system on a floor. It can be seen that such a shelving system can be rapidly assembled and disassembled, and uses only two additional posts for each additional shelving unit. The shelving system can be expanded by adding any number of shelving units, using either one or two posts 410 for each additional shelving unit.

Figure 5:
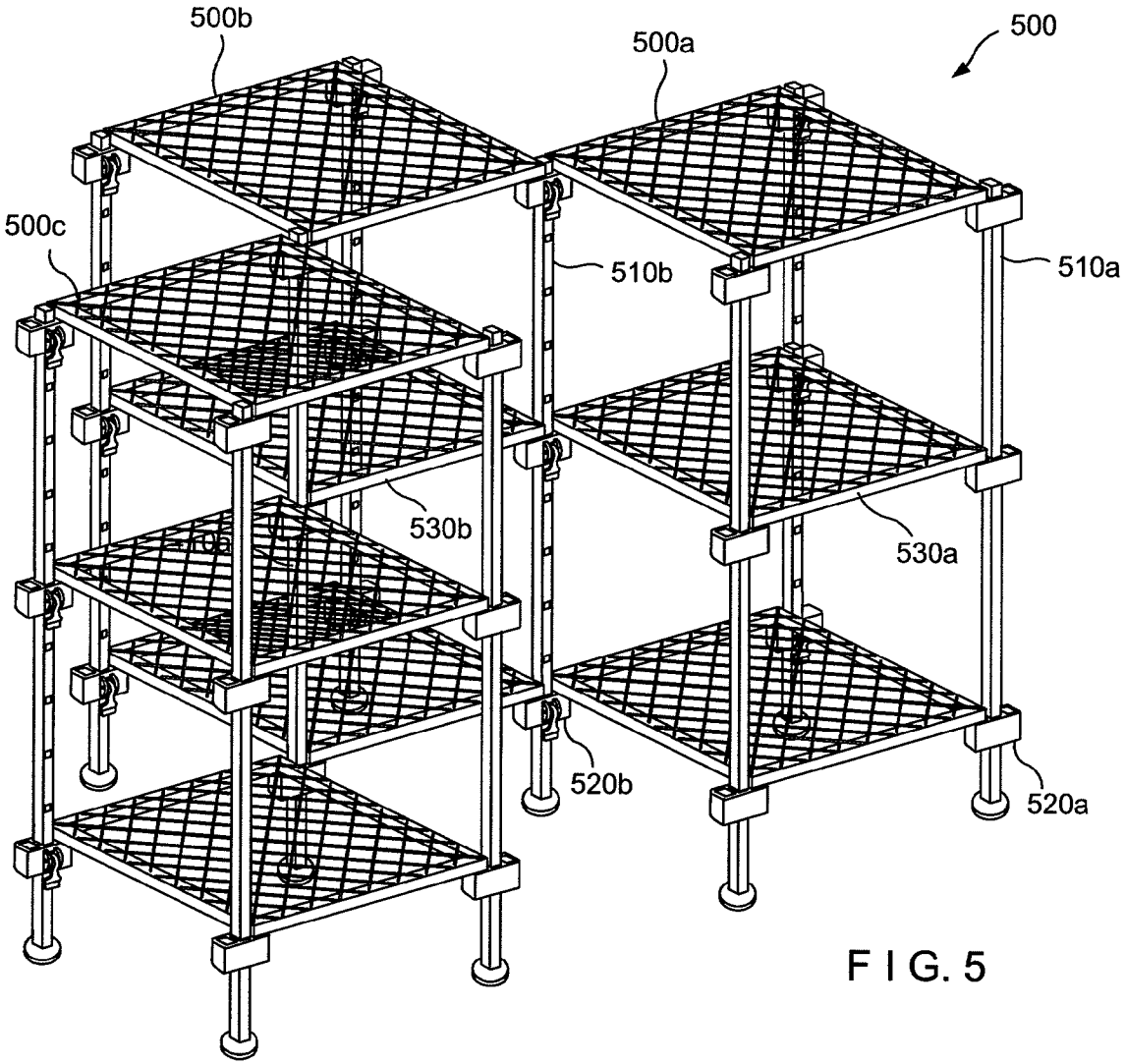
FIG. 5 illustrates a perspective view of a shelving system having shelving units expanded sideways and backwards.

FIG. 5 illustrates another embodiment of a shelving system 500 including three shelving units 500*a*, 500*b*, and 500*c*, configured in a U-shape. Here also, each shelving unit 500*a*, 500*b*, and 500*c* is joined to another using a common post 510*b*. In a particular embodiment, the posts are rectangular tubes. A connector 520*b* detachably connects shelving unit 500*a* to shelving unit 500*b* by mounting a protrusion of shelf 530*a* and a protrusion of shelf 530*b* to common connector 520*b*.

Figure 6:
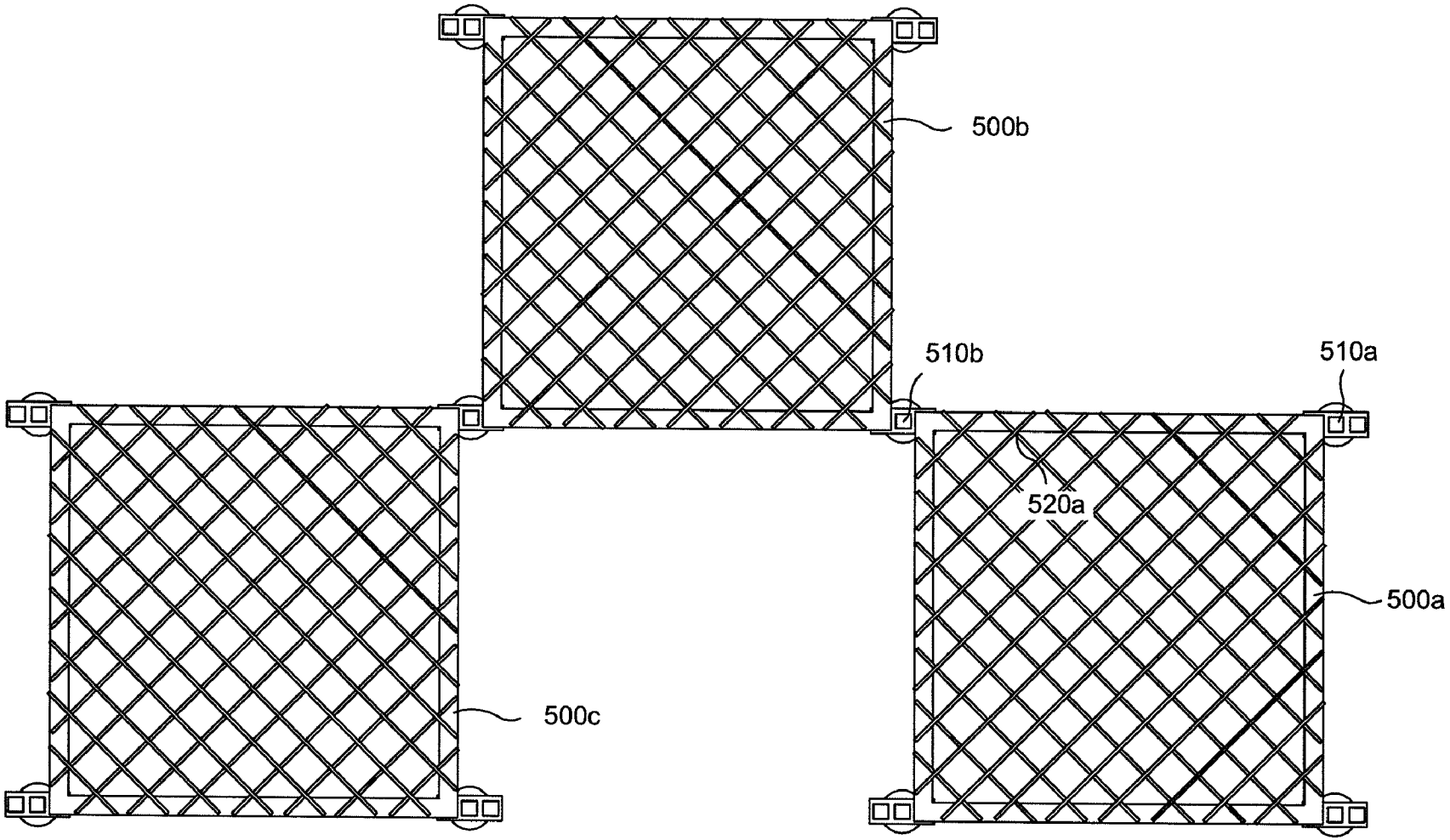
FIG. 6 illustrates top view of the shelving system of FIG. 5.

FIG. 6 illustrates a top view of the embodiment of FIG. 5. Post 510*a* supports a single shelving unit, while post 510*b* and connectors 520*a* and 520*b* support and join two shelving units 600*a* and 600*b*. Additional shelving units can be joined, either in the U-shaped configuration, straight as in FIG. 1, or diagonally as in FIG. 4. Other patterns of shelving may be created by combining shelving units in a similar manner.

Other embodiments are within the scope of the following claims.

What is claimed is:

1. A shelving unit, comprising:

a post having one or more indents along a length;

a shelf having a tubular frame and one or more protrusions on a periphery, the tubular frame having a frame opening adjacent the protrusion;

a connector having a first slot to receive the post that has a latch on the exterior, the latch in a first position engaging an indent and in a second position disengaging the indent, and a second slot to receive a shelf protrusion; and one or more stabilizing brackets having a mounting portion insertable into a respective frame opening and a stabilizing portion shaped to fit along an edge of the post, wherein the connector is mounted to the post by inserting the post in the first slot, sliding the connector to a desired location on the post, and putting the latch in the first position that inhibits further sliding of the connector, and wherein, when the stabilizing bracket is inserted in the frame opening, the stabilizing portion engages the edge of the post.

2. The shelving unit of claim 1, wherein the latch is rotatable and has a shaped portion to engage the indent when in the first position through an aperture in the first slot and when in the second position the shaped end is rotated, disengaging the indent, and enabling the connector to slide along the post.

3. The shelving unit of claim 1, wherein the shelf is rectangular and the protrusion is located substantially at a corner of the shelf.

4. The shelving unit of claim 3, wherein the first and second slots are rectangular.

5. The shelving unit of claim 3, wherein the post is rectangular.

6. The shelving unit of claim 5, wherein the mounting portion of the stabilizing bracket includes ridges that deform when the mounting portion is inserted into the frame opening, and wherein the stabilizing portion is L-shaped.

7. A method of assembling a shelving unit, comprising:

providing a post having indents along a length;

inserting the post through a first slot in a connector, the slot having a latch, the latch movable to a first position engaging an indent and movable to a second position disengaging the indent;

sliding the connector along the post until the connector is adjacent an indent at a desired location for a shelf, the shelf having a tubular frame with a protrusion formed on a periphery thereof;

moving the latch to the first position;

inserting a mounting portion of a stabilizing bracket into an opening of the tubular frame of the shelf adjacent the protrusion; and inserting the protrusion into a second slot on the connector, wherein sliding of the connector along the post is inhibited when the latch is in the first position and sliding of the connector along the post is enabled when the latch is in the second position, wherein the stabilizing bracket has a stabilizing portion that engages the post.

8. The shelving unit of claim 7, wherein the latch is rotatable and has a shaped portion to engage the indent when in the first position through an aperture in the first slot and when in the second position the shaped end is rotated, disengaging the indent, and enabling the connector to slide along the post.

9. The shelving unit of claim 7, wherein the shelf is rectangular and the protrusion is located substantially at a corner of the shelf.

10. The shelving unit of claim 8, wherein the first and second slots are rectangular.

11. The shelving unit of claim 9, wherein the post is rectangular.

12. The shelving unit of claim 11, wherein the mounting portion of the stabilizing bracket includes ridges that deform when the mounting portion is inserted into the frame opening, and wherein the stabilizing portion is L-shaped.

13. A shelving system, comprising:

two or more shelving units, each shelving unit comprising a post having one or more indents along a length;

one or more shelves each having a tubular frame and one or more protrusions on a periphery, the tubular frame having a frame opening adjacent the protrusion;

one or more connectors each having a first slot to receive the post that has a latch on the exterior, the latch in a first position engaging an indent on the post and in a second position disengaging the indent, and a second slot to receive the shelf protrusion; and one or more stabilizing brackets having a mounting portion insertable into a respective frame opening and a stabilizing portion shaped to fit along an edge of the post, wherein the connector is mounted to the post by inserting the post in the first slot, sliding the connector to a desired location, and putting the latch in the first position that inhibits further sliding of the connector, and the shelf is mounted to the post by inserting the shelf protrusion in the second slot, and wherein, a connector of a first shelving unit has a third slot and a shelf of a second shelving unit has a second protrusion that is inserted into the third slot, wherein, when the stabilizing bracket is inserted in the frame opening, the stabilizing portion engages an edge of the post.

14. The shelving unit of claim 13, wherein the latch is rotatable and has a shaped portion to engage the indent when in the first position through an aperture in the first slot and when in the second position the shaped end is rotated, disengaging the indent, and enabling the connector to slide along the post.

15. The shelving system of claim 13, wherein the shelf is rectangular and the protrusion is located substantially at a corner of the shelf.

16. The shelving system of claim 13, wherein the first, second, and third slots are rectangular.

17. The shelving system of claim 13, wherein the post is rectangular.

18. The shelving unit of claim 17, wherein the mounting portion of the stabilizing bracket includes ridges that deform when the mounting portion is inserted into the frame opening, and wherein the stabilizing portion is L-shaped.

19. The shelving system of claim 15, wherein the connector of the first shelving unit having the third slot receives a protrusion of a shelf having a second protrusion of the first shelving unit, the shelf of the second shelving unit having the second protrusion has the first protrusion inserted into the first slot of a connector having a third slot, and the second protrusion of the shelf of the first shelving unit inserts into the third slot of the connector of the second shelving unit.

20. A method of assembling a shelving system, comprising:

assembling a plurality of shelving units, the assembling of each shelving unit comprising:

providing a post having indents along a length;

inserting the post through a first slot in a connector, the slot having a latch in a second position, the latch movable to a first position engaging an indent and movable to the second position disengaging the indent;

sliding the connector along the post until the connector is adjacent an indent at a desired location for a shelf;

moving the latch to the first position;

inserting a mounting portion of first stabilizing bracket into an opening in a tubular frame of a shelf, the stabilizing bracket having a stabilizing portion that engages an edge of the post;

inserting a first protrusion formed on a periphery of the shelf adjacent the opening in the tubular frame into a second slot on the connector, wherein sliding of the connector along the post is inhibited when the latch is in the first position and sliding of the connector along the post is enabled when the latch is in the second position;

inserting a mounting portion of second stabilizing bracket into a second opening in a tubular frame of a shelf of a first shelving unit, the second stabilizing bracket having a second stabilizing portion that rests on an edge of a post of a second shelving unit; and inserting a second protrusion formed on the periphery of the shelf of the first shelving unit into a third slot of a connector of the second shelving unit.

* * * * *